United States Patent [19]

Frick

[11] 4,285,281

[45] Aug. 25, 1981

[54] TABLE AND A TABLE SUPPORT

[76] Inventor: Berndt E. Frick, Herrgårdsvägen 9, 135 00 Tyresö, Sweden

[21] Appl. No.: 40,721

[22] Filed: May 21, 1979

[30] Foreign Application Priority Data

May 19, 1978 [SE] Sweden ..... 7805747

[51] Int. Cl.[3] ..... A47B 9/00

[52] U.S. Cl. ..... 108/147; 108/144

[58] Field of Search ..... 108/147, 144; 5/63, 5/11; 74/665 GE, 89.15, 424.8 R; 248/656, 650, 422, 188.4

[56] References Cited

U.S. PATENT DOCUMENTS

| | | | |
|---|---|---|---|
| 918,240 | 4/1909 | Wheeler | 108/147 |
| 981,113 | 1/1911 | Richards | 108/147 |
| 1,943,280 | 1/1934 | Arnold | 108/147 |
| 2,500,168 | 3/1950 | Du Pont | 74/665 GE |
| 2,721,106 | 10/1955 | Chaney | 108/147 |
| 3,118,705 | 1/1964 | Stalnacke | 108/147 |
| 3,605,136 | 9/1971 | Vichness et al. | 5/63 |
| 4,151,804 | 5/1979 | Wache et al. | 108/147 |

*Primary Examiner*—James T. McCall

*Attorney, Agent, or Firm*—Burns, Doane, Swecker & Mathis

[57] ABSTRACT

The invention refers to a table and a table support in which the table top is cooperating with an elevating device vertically adjusting the table top into a predetermined position. The table top has on its under surface attached one part of the elevating device while the other parts are attached to the side portions of the table. The side portions include screw arrangements, while the table top includes sprockets cooperating with the screw. By turning the sprockets in one direction said table top is ascending and by turning the sprockets in the other direction said table top is descending.

5 Claims, 3 Drawing Figures

TABLE AND A TABLE SUPPORT

FIELD OF THE PRESENT INVENTION

The present invention relates to a table or a table support, said support is especially designated to carry a table top or the like. The support has a plurality, usually four, of legs and each leg has a screw bushing cooperating with a screw attached into said bushing.

DESCRIPTION OF THE PRIOR ART

It is previously known a plurality of constructions in order to elevate (ascending and descending) the table top relatively to the ground our floor in order to adjust the level of the table top exactly to the demand from the person working at the table or working at a device placed upon the table top. For this purpose it is previously known to use different complicated devices in order to actuate telescopic arranged legs simultaneously in order to cause the table top to ascend and descend in a horisontal position.

It is also previously known to arrange different devices in the lowermost parts of the legs, the actuation of these devices are intended to compensate for any height differences in the ground surface.

OBJECTS OF THE PRESENT INVENTION

The present invention has as its main object to give advise of such a device, which may cause an ascending and a descending of the table top, the surface of which is constantly having a horizontal position.

The present invention has also as its object to cause a compensation for any height differences in the ground surface.

An especial advantage caused by the present invention is that each screw is prior to their cooperation with an actuating device individually turnable in its screw bushing, in order to adjust the distance between the table top and the support, especially the side portions of the support or the legs, which may be suitable in order to compensate and eliminate any obliquity of the support or by purpose cause an obliquite or inclined position of the table top. Any height differences between the legs and ground surface may be compensated for by previously known devices.

One object of the present invention is to cause a synchronizing action between all screws in order to ascend or descend the table top to a predetermined position and having the top surface in one and the same plane, usually horizontal position.

A further object of the present invention is to cause an actuating device, which is so constructed that a turning of one screw is mechanically connected to all other screws, in order to turn them synchroniously and thus causing said horizontal ascending and descending.

It is a further object of the present invention to cause a special construction of the support, which makes it possible to have one part of the support attached to the table top, while the other parts, especially the side portions, may be constructed as separate units, thus improving the possibility to get a small transport volume for a dismanteled support and its table top.

Still a further object of the present invention is to cause a support construction, which, in spite of the previously mentioned objects may give a rigid support intended to stand heavy loads, especially caused from heavy devices placed upon the table top and when the operation of these devices causes vibrations.

The most significant features of the present invention is stated in the characterizing part of the succeeding claim 1.

BRIEF DESCRIPTION OF THE DRAWINGS

One embodiment having the novel features of the present invention shall be described in order to illustrate the present invention with reference to the attached drawing in which.

DESCRIPTION OF A PREFERRED EMBODIMENT

Figure 1:
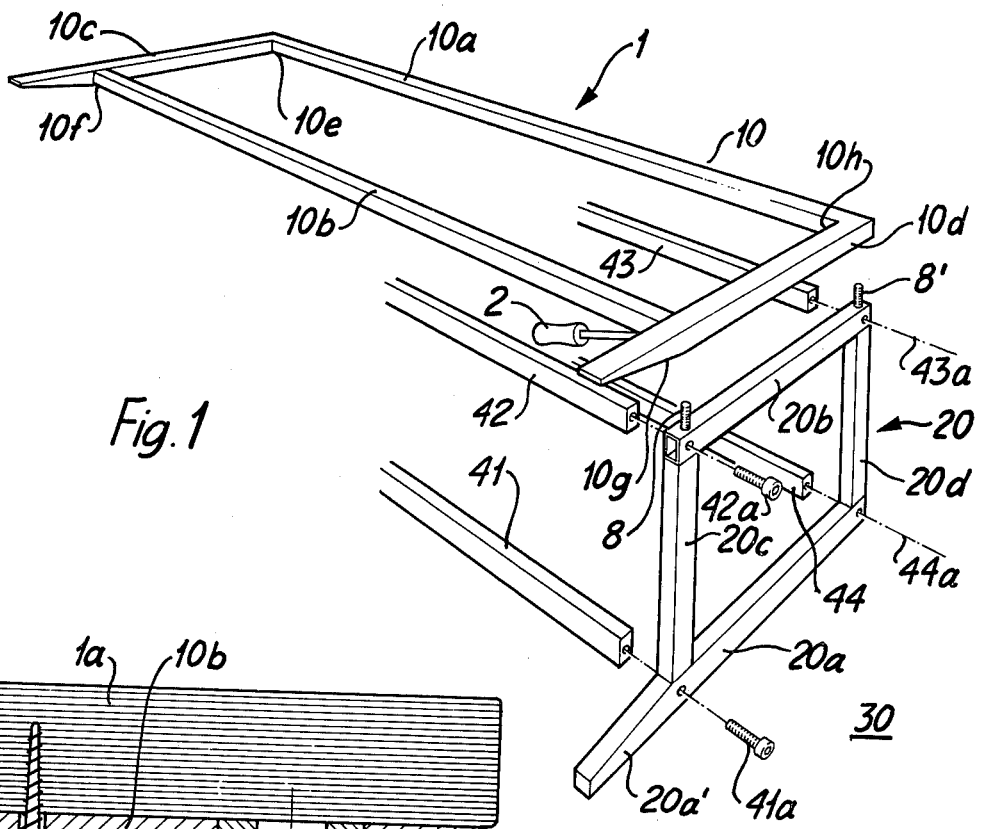
FIG. 1 is a perspective view of a support according to the invention.
Figure 2:
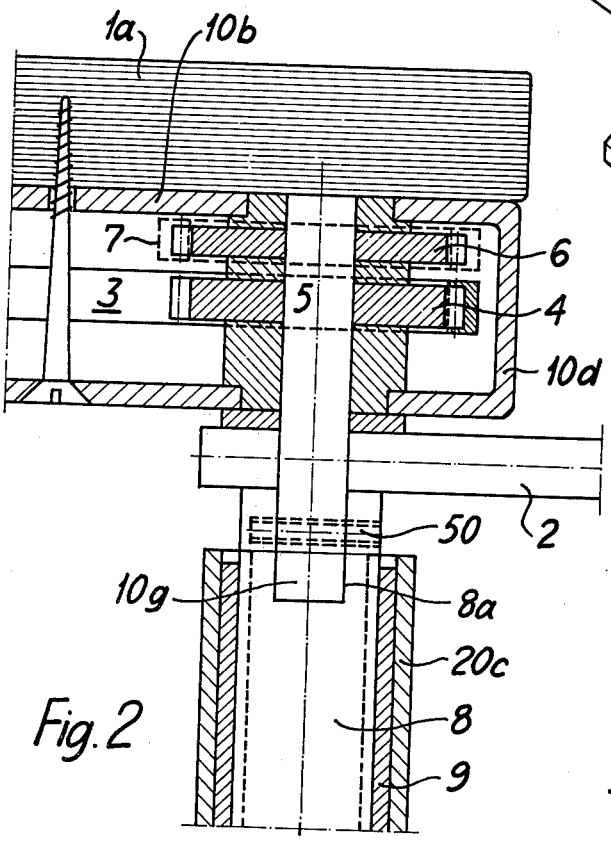
FIG. 2 is a cut view through the front part of an assembled support and FIG. 3 is a side elevation view showing a foot attached to the lowermost part of the support.

In FIG. 1 is shown a table 1 having in FIG. 1 not shown but in FIG. 2 shown table top 1*a*. This table top 1*a* shall be supported by a support constructed according to the present invention. Said support consists of a plurality of parts, which may be caused to cooperate with each other in a simple manner. One part of said support has been given the reference numeral 10 and is intended to be attached to the under surface of the table top 1*a*. This first part 10 consists of a rear beam 10*a*, a front beam 10*b*, parallel arranged to each other, and these beams are welded to two side beams 10*c* and 10*d*.

The parts 10*a*, 10*b*, 10*c* and 10*d* are as all other parts of the support, in the form of a hollow material, and in the drawings this is illustrated as a square beam with a square hole.

The first part 10 includes, within its interior space, a first sprocket mounted on a shaft member, the end portion of the shaft member is arranged outside said part 10 and has been given the reference numeral 10*e*. This sprocket is connected to a second sprocket by a chain arrangement, the end portion of the shaft member of said second sprocket having the reference numeral 10*f*. The axis for the second sprocket cooperates with a further sprocket, the upper sprocket is via a further chain through the beam 10*b* cooperating with the upper sprocket attached to the shaft member, said sprocket cooperates via a chain inside the beam 10*d* with a sprocket attached to a shaft member, the end portion of which has been given the reference numeral 10*h*.

By the aid of these sprocket arrangements in the corner portions of the first part of said support construction 10 and the intermediate arranged chains, it is possible to turn only one of these shaft members and thus cause a synchronious movement of the end portions of the shaft members 10*e*, 10*f*, 10*g* and 10*h* projecting outside said first part 10. It is suitable for the invention that all sprockets have the same number of teeth and the screws have the same pitch.

In FIG. 2 it has been illustrated, having the reference numeral 2, a handle 2 acting upon ratchet wheel and pawl, which may turn the shaft member having the end portion 10*g* either in one or the opposite direction. This handle may be substituted by a crank acting directly onto the upper surface of the screw.

The support according to the present invention consists of a second and/or a third part, only one is shown in FIG. 1, and has been given the reference numeral 20. This part consitutes one side portion and consists of a welded unit having a horizontal beam 20*a*, intended to face or cooperate with the beam 10*d*. The side portion has two vertical beams 20*c* and 20*d*, said beam 20*c* is the front beam. It should be mentioned that beam 20*a* is projecting further than beam 20*b* and the projecting portion has the reference numeral 20*a*'.

In order to get a rigid cooperation between two side portions there is provided a number of beams 41, 42, 43 and 44. These beams are by means of screws 41*a*, 42*a*, 43*a* and 44*a* attached towards said side portion 20.

Because of the fact that the sprocket arrangement for each corner in the first part 10 is identical, in spite of the modification entered to the corner between the beam 10*b* and 10*d*, just this part has been shown in FIG. 2.

In FIG. 2 it is shown that a chain arrangement 3 is connecting a not shown sprocket on the shaft member having the end portion 10*f* to a sprocket 4 attached to the shaft member 5 having the end portion 10*g*. This shaft member 5 cooperates with a further sprocket 6, which via a chain 7 is cooperating with a sprocket attached to the shaft member having the end portion 10*h*. By turning the shaft member 5 in one of two directions all the end portions 10*e*, 10*f*, 10*g* and 10*h* will turn in the same manner.

To said shaft member 5 is attached a handle 2, the mechanical construction of which is previously known and do not constitute any part of this invention. It can be noted that the turning of said handle 2 in one direction causes the shaft member to turn in the same manner, but the handle may be moved in opposite direction without causing any turning of the shaft member 5. The mechanism may be adjusted for opposite action.

It is essential for the present invention that each shaft member 5 has a device, a tenon 10*g*, which may cooperate with a corresponding device a hole 8*a*, formed in the uppermost part of each screw. The screw 8 is with its thread cooperating with a screw bushing 9, secured to the interior of the beam 20*c*. Prior to the cooperation of the tenon 10*g* with the hole 8*a* included in the uppermost part of the screw 8, the screw 8 is individually turnable in the screw bushing 9 so that the inclination of the table top is adjustable. The interconnection of the tenon 10*g* and the hole 8*a* has a fit which accommodates varying the inclination of the table top. The tenon 10*g* may have an irregular form and may have a regular hexagonal form, which correspond to the crossection of the hole 8*a* and thus a stable connection is established between the shaft member 5 and the screw 8. The present invention gives advice of a circular tenon and a circular hole and a screw 50 arranged radially. This screw 50 prevents the shaft member 5 to disengage the hole 8*a* by a vertical lifting movement of the table top.

All the other shaft members having end portions 10*e*, 10*f*, and 10*h* are constructed in exactly the same manner, as illustrated in FIG. 2, with the exception that the shaft members having end portions 10*e* and 10*h* have only one sprocket and one chain.

From FIG. 2 it is obvious that a turning of the handle in one of two directions, the rotation of the shaft member 5 will cause a corresponding rotation to the screw 8 and thus the table top 1*a* is ascending or descending. The end portion 10*g* shall coact with a screw 8'.

Figure 3:
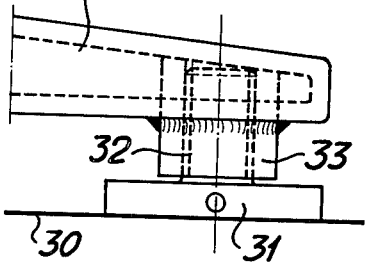

With reference to FIG. 3 the lower front part 20*a*' of the side portion 20 is shown. FIG. 3 shows that it has an adjustable foot 31 having a thread 32 coacting with a corresponding thread in a bushing 33, which is secured to the support. By this arrangement it is possible to turn the foot 31 in such a manner that the support is resting firmly towards the floor 30.

The invention is not restricted to the shown embodiment but can be modified with the the scope of the claims. Thus it should be mentioned that the part 10 may be built into the table top 1*a*.

What is claimed is:

1. A table having a table top which is selectively ascendable and decendable and having a table support, said table support comprising:

a first member, said first member being attached to the under side of said table top, and said first member including:

a plurality of shaft members, each of said shaft members having a tenon projecting outwardly from said first member;

a plurality of sprockets, each of said sprockets being mounted on one of said shaft members, and at least one of said shaft members having a plurality of sprockets mounted thereon;

a plurality of chain members, each of said chain members mechanically coupling one of said sprockets mounted on one of said shaft members to another of said sprockets mounted on another of said shaft members, such that each of said chain members mechanically couples only two of said sprockets; and actuating means for selectively rotating one of said plurality of shaft members, wherein when said one of said plurality of shaft members is selectively rotated, said plurality of sprockets and said plurality of chain members cooperate such that the tenons included on said plurality of shaft members rotate in synchronism in the same direction; and a side member, said side member including:

a plurality of screw members, each of said screw members being threadedly engaged with said side member, and each of said screw members having means for receiving the tenon included on one of said plurality of shaft members, such that each of said screw members rotates in unison with the tenon received by said screw member;

whereby when said actuating means selectively rotates the one of said plurality of shaft members in a first direction, said plurality of screw members rotate in synchronism in said first direction, thereby causing said table top to ascend, and further whereby when said actuating means selectively rotates the one of said plurality of shaft members in a second direction, said plurality of screw members rotate in synchronism in said second direction, thereby causing said table top to decend.

2. The table according to claim 1 wherein each of said plurality of screw members is individually turnable, whereby the inclination of said table top is adjustable.

3. A table having a table top which is selectively ascendable and descendable and having a table support, said table support comprising:

a first part, said first part being attached to said table top;

a second part, said second part being a first side portion of said table support, and said second part having first and second screw members, each of said first and second screw members being threadedly engaged with said second part;

a third part, said third part being a second side portion of said table support, and said third part having third and fourth screw members, each of said third and fourth screw members being threadedly engaged with said third part;

a plurality of beams, said beams being longitudinally disposed between said second part and said third part;

means for connecting said second part to a first end of each of said beams, and for connecting said third part to a second end of each of said beams, such that said plurality of beams and said second and third parts form a unit;

wherein said first part includes means for simultaneously actuating said first and second screw members included in said second part, and said third and fourth screw members included in said third part, said means for simultaneously actuating including:

a first shaft member;

a first sprocket, said first sprocket being mounted on said first shaft member;

first connecting means for mechanically connecting said first shaft members with said first screw member of said second part;

a second shaft member;

a second and a third sprocket, each of said second and third sprockets being mounted on said second shaft member;

second connecting means for mechanically connecting said second shaft member with said second screw member of said second part;

a third shaft member;

a fourth and a fifth sprocket, each of said fourth and fifth sprockets being mounted on said third shaft member;

third connecting means for mechanically connecting said third shaft member with said third screw member of said third part;

a fourth shaft member;

a sixth sprocket, said sixth sprocket being mounted on said fourth shaft member;

fourth connecting means for mechanically connecting said fourth shaft member with said fourth screw member of said third part;

first chain means for mechanically coupling said first sprocket to said second sprocket;

second chain means for mechanically coupling said third sprocket to said fourth sprocket;

third chain means for mechanically coupling said fifth sprocket to said sixth sprocket; and actuating means for selectively rotating one of said first, second, third and fourth shaft members, whereby when said one of said first, second, third and fourth shaft members is selectively rotated in a first direction, said first, second, third and fourth screw members all turn in a first manner, thereby causing said table top to ascend; and further whereby when said one of said first, second, third and fourth shaft members is selectively rotated in a second direction, said first, second, third and fourth screw members all turn in a second manner, thereby causing said table top to decend.

4. The table according to claim 3 wherein said first, second, third and fourth screw members are each individually turnable, whereby the inclination of said table top is adjustable.

5. A table having a table top which is selectively ascendable and decendable and having a table support, said table support comprising:

a first member attached to the under side of said table top, said first member including:

a plurality of shaft members, each of said shaft members having a tenon projecting outwardly from said first member;

a plurality of sprockets, at least one of said sprockets being mounted on each of said shaft members;

a chain member mechanically coupling one of said sprockets mounted on one of said shaft members to another of said sprockets mounted on another of said shaft members; and actuating means for selectively rotating one of said plurality of shaft members;

a plurality of side members, each of said side members having a screw member threadedly engaged with said side member, each of said screw members having means for receiving the tenon included on one of said plurality of shaft members such that each of said screw members rotates in unison with the tenon received by said screw member, and each of said screw members being individually turnable prior to receiving the tenon such that the inclination of said table top is adjustable; and means for rigidly connecting said plurality of side members, said means including a plurality of beams disposed between and connected to two of said side members;

wherein when said one of said plurality of shaft members is selectively rotated, said plurality of sprockets and said chain member cooperate such that the tenons included on said plurality of shaft members rotate in synchronism in the same direction;

whereby when said actuating means selectively rotates the one of said plurality of shaft members in a first direction, said plurality of screw members rotate in synchronism in said first direction, thereby causing said table top to ascend, and further whereby when said actuating means selectively rotates the one of said plurality of shaft members in a second direction, said plurality of screw members rotate in synchronism in said second direction, thereby causing said table top to decend.

* * * * *